US005593611A

United States Patent [19]

Czech

[11] Patent Number: 5,593,611

[45] Date of Patent: Jan. 14, 1997

[54] METHOD FOR IMPARTING SOFTNESS WITH REDUCED YELLOWING TO A TEXTILE USING A LOW AMINE CONTENT, HIGH MOLECULAR WEIGHT AMINOPOLYSILOXANE

[75] Inventor: Anna M. Czech, Cortlandt Manor, N.Y.

[73] Assignee: OSi Specialties, Inc., Danbury, Conn.

[21] Appl. No.: 265,480

[22] Filed: Jun. 24, 1994

Related U.S. Application Data

[63] Continuation-in-part of Ser. No. 905,380, Jun. 29, 1992, abandoned.

[51] Int. Cl.[6] ..... D06M 15/643

[52] U.S. Cl. ..... 252/8.63; 510/515; 528/28; 528/33; 528/34; 528/38; 524/838

[58] Field of Search ..... 252/8.6, 8.8, 8.9, 252/8.63; 528/28, 33, 34, 38; 524/838; 510/515

[56] References Cited

U.S. PATENT DOCUMENTS

| | | | |
|---|---|---|---|
| 2,921,950 | 1/1960 | Jex et al. | 260/448.2 |
| 3,146,250 | 8/1964 | Speier | 260/448.2 |
| 4,247,592 | 1/1981 | Kalinowski | 428/266 |
| 4,409,267 | 10/1983 | Ichinobe et al. | 427/387 |
| 4,585,563 | 4/1986 | Busch et al. | 252/8.8 |
| 4,661,577 | 4/1987 | Jo Lane et al. | 528/10 |
| 4,800,026 | 1/1989 | Coffindaffer et al. | 252/8.8 |
| 4,921,895 | 5/1990 | Schaefer et al. | 524/379 |
| 4,950,545 | 8/1990 | Walter et al. | 428/446 |
| 4,978,363 | 12/1990 | Ona et al. | 8/581 |
| 5,000,861 | 3/1991 | Yang | 252/8.6 |
| 5,017,297 | 5/1991 | Spyropoulos et al. | 252/8.8 |
| 5,039,738 | 8/1991 | Czech | 524/838 |
| 5,059,282 | 10/1991 | Ampulski et al. | 162/111 |
| 5,064,544 | 11/1991 | Lin et al. | 252/88 |
| 5,070,168 | 12/1991 | O'Lenick, Jr. | 528/10 |
| 5,104,555 | 4/1992 | Foster et al. | 252/8.6 |
| 5,153,294 | 10/1992 | O'Lenick, Jr. | 528/26 |
| 5,173,201 | 12/1992 | Coffindaffer et al. | 252/8.8 |
| 5,174,911 | 12/1992 | Lin et al. | 252/8.6 |
| 5,174,912 | 12/1992 | Coffindaffer et al. | 252/8.8 |
| 5,269,951 | 12/1993 | McVie et al. | 252/8.6 |
| 5,300,237 | 4/1994 | Ona et al. | 252/8.6 |
| 5,300,238 | 4/1994 | Lin et al. | 252/8.6 |
| 5,302,657 | 4/1994 | Huhn et al. | 524/588 |
| 5,336,419 | 8/1994 | Coffindaffer et al. | 252/8.6 |
| 5,391,400 | 2/1995 | Yang | 427/389.9 |
| 5,474,835 | 12/1995 | McCarthy et al. | 428/224 |

FOREIGN PATENT DOCUMENTS 0417559 3/1991 European Pat. Off. .

OTHER PUBLICATIONS

Streitwieser, Jr. Introduction to Organic Chemistry, 3rd ed. (1985)* p. 469 no month available.

A. Streitwieser, Jr., and C. H. Heathcock –Introduction to Organic Chemistry 3rd ed., 686 (1985) *no month available.

F. R. Eirich –Rheology, Theory and Applications, 340–343 (1956) *no month available.

*Primary Examiner*—Douglas J. McGinty
*Assistant Examiner*—Michael P. Tierney

[57] ABSTRACT

A method is provided for treating a textile to impart amine-like softness and reduced yellowing, which method comprises treating a textile with an- aminopolysiloxane having an amine content as $NH_2$ ranging from about 0.15 to 0.25 percent by weight as NH2 and having a molecular weight of at least about 30,000.

7 Claims, 1 Drawing Sheet

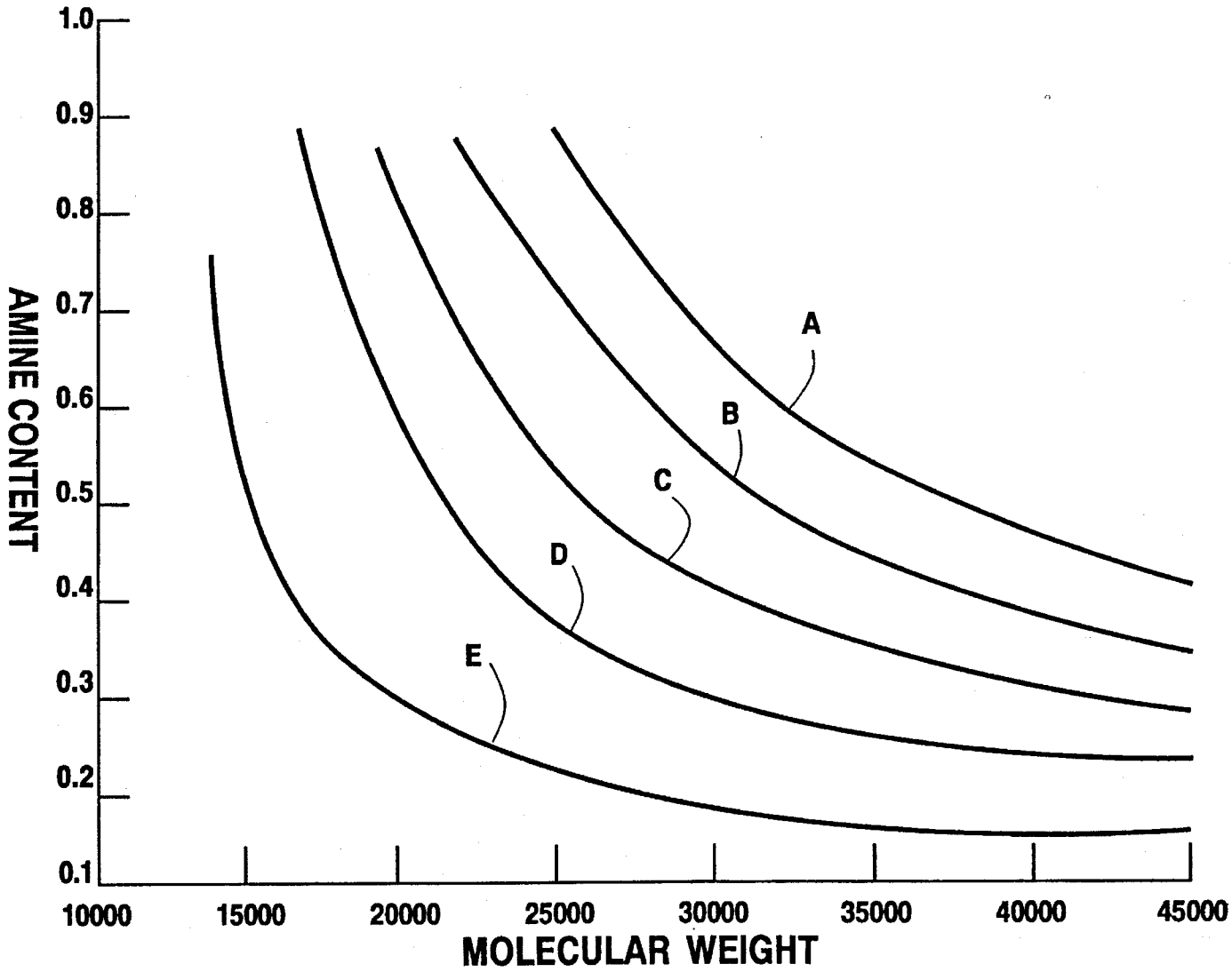
A
B
C
D
E
1.0
0.9
0.8
0.7
0.6
0.5
0.4
0.3
0.2
0.1
AMINE CONTENT
10000
15000
20000
25000
30000
35000
40000
45000
MOLECULAR WEIGHT

METHOD FOR IMPARTING SOFTNESS WITH REDUCED YELLOWING TO A TEXTILE USING A LOW AMINE CONTENT, HIGH MOLECULAR WEIGHT AMINOPOLYSILOXANE

The present application is a continuation-in-part of U.S. patent application Ser. No. 07/905,380 filed on Jun. 29, 1992, which is now abandoned.

FIELD OF THE INVENTION

The present invention relates to a method for treating a textile to impart softness with reduced yellowing. More particularly, the present invention relates to a method for treating a textile with an aminopolysiloxane having an amine content ranging from about 0.15 to 0.25 percent by weight as $NH_2$ and a molecular weight of at least 30,000.

BACKGROUND OF THE INVENTION

It is well-established that selecting a silicone polymer for textile finishing often requires a trade-off in properties. For example, softness and non-yellowing are a highly desired combination of properties for textiles such as fibers and fabrics, both woven and non-woven. By softness is meant the quality perceived by users through their tactile sense to be soft. Such tactile perceivable softness may be characterized by, but not limited to resilience, flexibility, and smoothness and subjective descriptions such as "feeling like silk or flannel."

Aminopolysiloxanes are known to impart such softness or improve the "hand" of a textile. It has been generally understood that softness of a textile treated with an aminopolysiloxane is directly related to the amine content (the number of amino-functional groups) of the polysiloxane. That is, as the amine content of the aminopolysiloxane used to treat the textile is increased, the softness imparted to the textile increases. Conversely, as the amine content of the aminopolysiloxane is decreased, likewise, the softness of the textile decreases. Unfortunately, as the amine content of the aminopolysiloxane is increased to provide softness to a textile, it also causes the textile to discolor or yellow. That is, the higher the amine content of the aminopolysiloxane used to treat a textile, the more discolored or yellowed the textile becomes.

When yellowing of the textile is a concern, it has been the textile industry's practice to impart softness to a textile by treating it with an aminopolysiloxane in which the amino-functional groups have been chemically modified so that such groups are less reactive or susceptible to oxidation, and, hence, less yellowing. Textile treatment using such chemical modification include treating a textile with a polysiloxane containing amide groups or carbamate groups to provide a soft, less-yellowed textile. However, those skilled in the art in assessing softness have reported that these polysiloxanes whose chemical reactivity have been modified by forming amide or carbamate groups do not possess or retain what has been subjectively described as "the amine-like softness or amine-like hand." That is, a textile treated with a polysiloxane modified by amide or carbamate groups does not have the same subjective feel of softness as a textile treated with an unmodified, reactive aminopolysiloxane.

Commercially, to maintain an amine-like hand or amine-like softness, textiles have been treated with aminopolysiloxanes having an amine content ranging from about 0.4 to 2.5 percent by weight as $NH_2$. However, textiles treated with aminopolysiloxanes having this level of amine content are known to exhibit yellowing. Additionally, treating a textile with such levels of amine content or higher levels may raise environmental acceptability concerns. For example, treating textiles with an aminopolysiloxane having such level of amine content may cause corrosivity, irritation to skin and eyes, and/or breathing difficulty during application. Accordingly, there is an on-going need to provide a method for treating a textile to impart "amine-like" softness and reduced yellowing and which method is more environmentally acceptable.

The textile industry has commonly characterized aminopolysiloxanes used to impart softness and other polysiloxanes (substituted with other functional groups and unsubstituted alike) by the viscosity. In general, it has been widely believed in the textile industry that the viscosity of polysiloxanes (substituted and unsubstituted) useful in textile treatment may vary so long as the polysiloxane is flowable or can be made flowable for a particular application. The industry has used viscosity to characterize polysiloxanes useful in textile treatment stating that viscosity is directly related to molecular weight and more easily ascertainable than molecular weight when the polysiloxane formula or the raw materials from which it was made are unknown. See, for example, U.S. Pat. No. 5,059,282 at Col. 2, lines 46–68 and Col. 8, lines 3–30, and Silicon Compounds, 1987, pp. 262 distributed by Petrarch Systems (Bristol, Pa.). However, for a substituted polysiloxane such as an organomodified polysiloxane, for example, an aminopolysiloxane, a direct correlation between viscosity and molecular weight is more complex. For a given degree of polymerization, the viscosity of organomodified polysiloxanes is related to the type of organo-functionality (i.e., amino, carboxyl, carbonyl) and to the amount of that functionality in the polymer. As a consequence of the wide use of viscosity to characterize various polysiloxanes, especially aminopolysiloxanes, the importance of the combination of the amine content and molecular weight on the aminopolysiloxane's ability to provide softness, especially softness with non-yellowing has not been recognized.

SUMMARY OF THE INVENTION

Surprisingly, the method of the present invention imparts softness at least equivalent to commercial aminopolysiloxane softeners containing higher levels of amine content and provides the additional benefit of being non-yellowing and/or having a reduced tendency to discolor the treated textile. Textiles treated in accordance with the method of the present invention retain an amine-like softness or amine-like hand. Since the aminopolysiloxane used in the method of the present invention contains a lower amine content as compared to those being used commercially, environmental acceptability could be less of a concern. The present invention provides a method for treating a textile to impart amine-like softness and reduced yellowing, which method comprises treating the textile with an aminopolysiloxane having an amine content ranging from about 0.15 to 0.25 percent by weight as $NH_2$ and having a molecular weight of at least about 30,000.

BRIEF DESCRIPTION OF THE FIGURE

FIG. 1 is a representation of the predictive/regression model set forth in Example 2 and herein. Softness values are set forth in terms of amine content (along the y-axis) and molecular weight (along the x-axis).

DETAILED DESCRIPTION OF THE INVENTION

Textiles which can be treated by the method of the present invention are exemplified by (i) natural fibers such as cotton, flax, silk and wool; (ii) synthetic fibers such as polyester, polyamide, polyacrylonitrile, polyethylene, polypropylene and polyurethane; and (iii) inorganic fibers such as glass fiber and carbon fiber. Preferably, the textile treated by the method of the present invention is a fabric produced from any of the above-mentioned fibrous materials or blends thereof. Most preferably, the textile is a cotton-containing fabric such as cotton or a cotton-polyester blend.

In the method of the present invention the textile is treated or contacted with an aminopolysiloxane to afford an add-on from about 0.1 to 2.0%, preferably from about 0.2 to 1.5% by weight, of the aminopolysiloxane based upon the weight of the textile. By "add-on" is meant the amount of aminolpolysiloxane that remains on the textile after it is dried and cured. Aminopolysiloxanes employed in the method of the present invention have an amine content as $NH_2$ ranging from about 0.15 to 0.25 percent by weight and a molecular weight of at least about 30,000. Preferably, the molecular weight of the aminopolysiloxane ranges from about 30,000 to 80,000; and most preferably ranges from about 35,000 to about 60,000.

The aminopolysiloxane employed in the method of the present invention is hydrophobic. By hydrophobic is meant that the textile treated with the aminopolysiloxane is not "wettable", i.e., capable of absorbing water.

The aminopolysiloxane employed in the method of the present invention can be random or block and is defined by Formula I: $PR_2SiO(R_2SiO)_a(RQSiO)_bSiR_2P$, wherein R is a monovalent hydrocarbon group having 1 to 10 carbon atoms including alkyl, aryl and aralkyl groups. The R groups may be the same or different from one another and are illustrated by methyl, ethyl, butyl, hexyl and benzyl. Of these, lower alkyls ($C_1$–$C_4$) are preferred. Most preferably R is methyl. P can be the same as R or be selected from the group consisting of Q, hydroxyl and an alkoxy ($C_1$–$C_4$). Preferably, the alkoxy group is selected from the group consisting of methoxy and ethoxy.

In Formula I, a and b are selected such that the amine content ranges from about 0.15% to 0.25% (as $NH_2$) and the molecular weight of the polymer is 30,000 or higher. Preferably a ranges from about 400 to about 1,100 and b ranges from about 1.4 to 13; most preferably a ranges from about 470 to about 800, and b ranges from about 1.75 to 9.6. It is understood by the one of ordinary skill that in order to obtain the aminopolysiloxanes with the amine content as specified above, a and b have to be selected in such a way that the ratio of a to b ranges from about 83 to about 330.

The Q group of Formula I comprises one or more amine groups and may also contain hydroxyl substitution. More particularly, Q has the general Formula II: $—(X)_d(X^1)_e(Y)_f—N(R^1)(R^2)$ wherein X is an alkylene group having 1 to 8 carbon atoms such as, for example, methylene, ethylene, propylene, or hexylene, and preferably has 2 to 4 carbon atoms; $X^1$ is a divalent organic radical including alkylene of 1 to 4 carbon atoms (such as, for example, methylene, ethylene and propylene) or phenylene or preferably oxypropylene (i.e., $—C_3H_6O—$, the oxygen of which is bonded to a carbon atom of the Y group); Y is a hydroxyl-substituted acyclic alkylene group of 2 to 8 carbon atoms and is illustrated by 2-hydroxylpropylene, i.e., $—CH_2CH(OH)CH_2—$, or Y is a hydroxyl-substituted cyclic alkylene group having no more than 8 carbon atoms as illustrated by 2-hydroxycyclohexylene, i.e., of which the acyclic groups having 2 to 4 carbon atoms are preferred; d, e and f are zero or one provided the sum of e+f is zero or two; and $R^1$ and $R^2$ are independently hydrogen or an alkyl having from 1 to 8 carbon atoms of which lower alkyls ($C_1$–$C_4$) are preferred, or a hydroxyalkyl group having from 2 to 4 carbon atoms, or an alkyleneamino group. The alkyleneamino group within the scope of $R^1$ and $R^2$ of Formula II in turn has the following Formula III: $—C_gH_{2g}N(R^3)(R^4)$ wherein: (III) $R^3$ and $R^4$ are independently hydrogen, alkyl or hydroxyalkyl as defined with reference to $R^1$ and $R^2$, and g is an integer from 2 to 8, preferably no more than 4.

It is to be understood that the amino groups encompassed by Formulas II and III may be used in their protonated form or quaternized form without departing from the scope of this invention. From the above, it is evident that the amino-containing group, Q, can be a mono-, diamino- or polyamino group of the following types where the specific groups shown for X, $X^1$, Y and $R^1$–$R^4$ and the value of g are selected for illustrative purposes only: $—C_3H_6NH_2$; $—C_3H_6N(C_2H_5)_2$; $—C_3H_6N(CH_2CH_2OH)_2$; $—C_3H_6N(CH_3)CH_2CH_2NH_2$; $—C_3H_6NHCH_2CH_2NH_2$; $—C_3H_6O—CH_2CH(OH)CH_2NH_2$; $—C_3H_6N(CH_2CH_2OH)(CH_2CH_2NH_2)$; and $—C_3H_6O—CH_2CH(OH)CH_2N(H)CH_2CH_2NH_2$.

The preparation of aminoorganosiloxanes and their aqueous emulsions are known to those skilled in the art. For example, the preparation of aminoorganosiloxanes is disclosed in U.S. Pat. Nos. 3,003,815; 3,146,250; 3,335,424; 2,981,920 and 2,921,950. In order to make aminopolysiloxanes having amine content from 0.15 to 0.25% and molecular weight of at least 30,000 procedures set forth in the above-mentioned patents are applicable. The desired amine content and molecular weight can be accomplished by employing appropriate charges of the reactants.

Typically, aminopolysiloxanes of the method of the present invention are prepared, for example, as disclosed in U.S. Pat. No. 4,247,592 by hydrolyzing amine-containing dialkoxysilanes (source of RQSiO groups as defined by Formula I) in excess water and equilibrating the resulting hydrolyzate with dimethylcyclopolysiloxanes (source of $R_2SiO$ groups as defined by Formula I) and decamethyltetrasiloxane (source of $R_3SiO$ groups as defined by Formula I) in the presence of a base catalyst such as KOH with heating.

The reactive aminopolysiloxanes having hydroxy or alkoxy terminal groups ($PR_2SiO$, where P is different than R as defined in formula I) are prepared in a similar and well-known manner from amine-containing silanes and dimethylcyclopolysiloxanes. In an alternative approach, aminopolysiloxanes employed in the method of the present invention can be prepared from organomodified polysiloxanes, such as epoxypolysiloxane, of the desired molecular weight and level of functionality, using well-known epoxy ring opening reactions with amines such as those disclosed in U.S. Pat. No. 4,409,267.

Preferably, the composition to be added to the textile does not include an organotitanate, an organozirconate, or organogermanate or similar metalo-organic compounds as are required by some of the prior art teachings. Such additives were thought to be required for a polysiloxane to be absorbed onto a textile.

While the aminopolysiloxane of the method of the present invention can be used neat, for ease of application, it is usually applied to the textile dissolved, dispersed or emulsified in a suitable liquid medium. Preferably, for example, the aminopolysiloxane in the method of the present invention can be applied to the textile from an aqueous solution, emulsion, or suspension. The aminopolysiloxane may also be applied as a solution in a nonaqueous solvent such as isopropanol and hexane, or in a liquid in which the aminopolysilxane is miscible such as, for example, toluene. Most preferably, the aminopolysiloxane is applied to the textile as an aqueous emulsion.

The preparation of aqueous emulsions of aminopolysiloxanes is well known to those skilled in the art. One such preparation is described, for example, in U.S. Pat. No. 5,039,738. To prepare an aqueous emulsion, an aminopolysiloxane is optionally combined with emulsifiers known in the art and diluted to a desired polymer level with water.

In the method of the present invention, aminopolysiloxane emulsion can be diluted with water to a desired polymer level and applied onto a fiber or fabric textile, such as by spraying, dipping or kiss roll application. Indeed, it will be more common to prepare an emulsion at a higher polymer content to reduce shipping and/or handling costs and then dilute the emulsion with water immediately prior to use. The polymer content of the aminopolysiloxane emulsion of the method of the present invention ranges from about 10 to 80 percent, preferably about 20 to 40 percent based upon the total weight of the emulsion. Optionally, other additives typically employed in treating textiles can be included in the emulsion or applied separately to the textile.

Such additives can include, for example, a durable press resin, curing catalyst, preservatives or biocides, water-soluble pigments or dyes, fragrances, fillers, pH adjustors and antifoamers or defoamers can be employed. However, it is preferable that organotitanes, organozirconates or organogermanates or similar metalo-organic compounds should be avoided because they may be corrosive or irritating, as well as, because they may have a negative effect on the stability of the treating compositions.

After the textile is dried either at room temperature or by heat, it is then cured at a temperature less than the melting or decomposition temperature of the textile. Heating can be done by any suitable method, but preferably is done by passing the textile through a hot air oven. The resulting treated textile, thus, has properties such as amine-like softness or amine-like hand and whiteness (i.e., is non-yellowing).

Whereas the exact scope of the instant invention is set forth in the appended claims, the following specific examples illustrate certain aspects of the present invention. However, the examples are set forth for illustration only and are not to be construed as limiting on the present invention. All parts and percentages are by weight unless otherwise specified.

EXAMPLES

In the examples, textiles were conditioned for testing in accordance with ASTM Method D-1776-79. A durable press resin (commercially available dimethyloldihydroxy-ethyleneurea, "DMDHEU") and a curing catalyst ($MgCl_2$) were used in the treatment of the textiles to simulate typical textile finishing. Non-yellowing or whiteness of the textile was determined in accordance with AATCC Method 110-1979 entitled "Reflectance, Blue and Whiteness of Bleached Fabric." The textiles in the examples were not treated with bleach to provide whiteness or to reduce yellowing.

Softness and/or amine-like hand evaluations were performed by a hand panel. For the softness evaluation, textiles were rated using a 1-to-10 scale on which scale, 1 was the softest and 10 was the harshest value. Fluids A and B are two commercially available softeners. Softener A (having a softness value of 3.0) and Softener B (having a softness value of 2.0) as described in Table 1 were used as controls for textiles treated in accordance with the method of the present invention. Fluid C is a dimethyl silicone oil available from OSi Specialties, Inc. of Danbury, Conn. under the designation LE-46 (a 35% aqueous emulsion of dimethyl silicone oil).

Amine content of the aminopolysiloxane used in the method of the present invention was determined by the following procedure: 5 grams of aminopolysiloxane is dissolved in 50 to 100 milliliters of iso-propanol in an Erlenmeyer flask. To this solution is added 5 milliliters of water and three drops of Bromocresol green. The solution is titrated with 0.1N hydrochloric acid until the color changes from blue to yellow/green. The amine content is calculated as follows: % amine=[(N×V)/W]×1.6, in which N=actual normality of HCl solution, V=volume of HCl used in titration, W=weight of aminopolysiloxane sample.

Molecular weight of the aminopolysiloxane was calculated based upon the amount of starting materials used to prepare the aminopolysiloxane as follows. Molecular weight of the aminopolysiloxane equals the molecular weight of hexamethyldisiloxane plus (the equivalent molecular weight of dimethylsiloxy unit multiplied by the number of units) plus (the equivalent molecular weight of aminomodified siloxy unit multiplied by the number of units).

Example 1: Preparation of Aminopolysiloxane Emulsions

The aminopolysiloxanes set forth in Table 1 were prepared in accordance with the procedure disclosed in U.S. Pat. No. 4,247,592 and formulated into emulsions. To form an emulsion, the aminopolysiloxane was mixed in a vessel with a surfactant blend of 3.6 parts TERGITOL® 15-S-15 (a polyethylene glycol ether of a linear alcohol having 11 to 15 carbon atoms) and 2.4 parts TERGITOL® 15-S-3 (a polyethylene glycol ether of a linear alcohol having 11 to 15 carbon atoms ) and 12 parts water to form a premix. The premix was placed in the feeder and passed at 3,000 to 4,000 psig through a Homogenizer Type 15M from Manton-Graulin Mfg. Co., Inc. (Evert, Mass.). The remaining water (48 parts) was added slowly to the homogenizer feeder. At the same pressure, the mixture was passed twice through the homogenizer. The emulsion contained 40 parts of aminopolysiloxane to 60 parts water.

| Fluid | Formula[1] | Amine Content[2] (as % $NH_2$) | Molecular Weight | Panel Softness Cotton | Panel Softness C/PE[3] | Model Prediction Softness | Viscosity .cSt |
|---|---|---|---|---|---|---|---|
| A | $MD_{140}D^*_{1.4}M$ | 0.50 | 11,500 | 3.0 | 3.0 | 3.26 | 200 |

-continued

| Fluid | Formula[1] | Amine Content[2] (as % $NH_2$) | Molecular Weight | Panel Softness Cotton | Panel Softness C/PE[3] | Model Prediction Softness | Viscosity .cSt |
|---|---|---|---|---|---|---|---|
| B | $MD_{250}D^*_6M$ | 0.90 | 19,700 | 2.0 | 2.0 | 1.74 | 1,100 |
| C | Dimethyl Silicone Oil | 0.00 | 60,000 | 8.0 | 7.0 | — | 10,000 |
| I | $MD_{300}D^*_{3.0}M$ | 0.50 | 23,000 | 2.0 | — | 2.22 | 1,700 |
| II | $MD_{400}D^*_{4.0}M$ | 0.50 | 30,000 | 1.5 | — | 1.58 | 2,200 |
| III | $MD_{500}D^*_{5.0}M$ | 0.50 | 38,000 | 1.0 | — | 0.86 | 7,300 |
| 1 | $MD_{400}D^*_2M$ | 0.22 | 30,100 | 2.5 | 2.0 | 2.79 | 1,800 |
| 2 | $M^*D_{400}M^*$ | 0.22 | 30,200 | 2.5 | 2.5 | 2.79 | — |
| 3 | $MD_{500}D^*_2M$ | 0.20 | 37,600 | 2.5 | 2.0 | 2.75 | 4,900 |
| 4 | $MD_{500}D^*_3M$ | 0.25 | 37,700 | 2.0 | 2.5 | 2.41 | 3,800 |
| 5 | $MD_{600}D^*_2M$ | 0.18 | 45,000 | 3.0 | 3.0 | 2.71 | 7,800 |
| IV | $MD_{200}D^*_{1.0}M$ | 0.20 | 15,000 | 3.5 | — | 3.20 | 680 |
| V | $MD_{370}D^*_{1.7}M$ | 0.20 | 28,000 | 3.5 | — | 2.92 | — |
| VI | $MD_{500}D^*_1M$ | 0.10 | 37,500 | 3.5 | — | 3.32 | 6,200 |
| VII | $D_{200}D^*$ | 0.22 | NOT KNOWN[4] | 3.5 | 2.0 | — | 705 |

[1]$M = O_{1/2}Si(CH_3)_3$
$D = OSi(CH_3)_2$
$D = OSi(CH_3)C_3H_6NHC_2H_4NH_2$
$M = O_{1/2}Si(CH_3)_2C_3H_6OCH(OH)CH_2NHC_2H_4NH_2$
[2]amine content determined by titration
[3]Cotton/Polyester blend (65/35) fabric
[4]Condensed so that molecular weight could not be determined

Example 2: Prediction Model for Softness

A prediction model for softness was generated using Minitab® Statistical Software, copyright 1989, Minitab, Inc. (State College, Pa.). Using the software, the procedure used for developing a statistical model for predicting softness, such as depicted in FIG. 1, was a least squares regression procedure. The effects included in the model were (1) amine content (ac) and (2) molecular weight (mw) as well as their interaction (ac*mw) and the two quadratic effects (ac*ac and mw*mw). The steps followed in model development were:

(a) center data (i.e., for each (1) and (2) effect, subtract its mean from each of its values;

(b) generate the interaction and quadratic effects from the centered data;

(c) use the centered data in a forward and stepwise procedure which sequentially chooses the significant variables for the regression model until no other variables are determined to be significant;

(d) verify these significant variables with the centered data and a backward stepwise procedure which sequentially eliminates the insignificant variables from the regression model;

(e) use the uncentered (actual) data in the least squares regression procedure to determine the model parameters (i.e., coefficients).

In accordance with the program, softness data have been analyzed as a function of the amine content and molecular weight for aminopolysiloxanes I–VII, 1–5, and controls A and B, as specified in Example 1. Reactive aminopolysiloxane VII was excluded from the analysis because the effective molecular weight of cured polymer could not be defined. The stepwise regression of the centered data was chosen in order to identify all significant terms and interactions which subsequently were used to generate a prediction model. The following regression model was obtained from the data:

TABLE 2

| Softness Constant | $X_1$ | $X_2$ | $X_1X_2$ | $X_1^2$ | $R^2$ | s |
|---|---|---|---|---|---|---|
| Model 2.997 | 2.610 | 2.472.E-5 | 2.307.E-4 | | 84.9 | 0.3543 |

The model defines softness value (S) in terms of the amine content ($X_1$) as $NH_2$ and molecular weight of the polymer ($X_2$). Softness=2.977+2.610 ($X_1$) 2.472.10–5($X_2$)–2.370.10–4($X_1X_2$) The relationship between the predicted softness, amine content as NH2, and molecular weight are depicted by the contour plots (A–E) set forth in FIG. 1. The softness values of contour plots A through E are: A=1, B=1 D=2.5 and E=3. Contour plots (A–E) can be used to:

1. Estimate softening properties of the animopolysiloxane if amine content and molecular weight are known. Softness value is found at the intersection of lines drawn parallel to the axes for the given amine content and molecular weight. Exact softness values are provided for the intersection point located on the contour lines; for the points located between the lines, softness value can be estimated based on the distance from the lines.
2. Determine amine content and molecular weight of the aminopolysiloxanes resulting in desired softening properties. Lines drawn through the selected softness point parallel to the axes will intersect with the axes at the points corresponding to the amine content and molecular weight of the aminopolysiloxane resulting in the desired softening properties.

From FIG. 1, it can be seen that aminopolysiloxanes having an amine content as $NH_2$ ranging from about 0.15 to 0.25 and a molecular weight of at least 30,000 resulted in a softness value ranging from about 2 to about 3, which softness is comparable to aminopolysiloxanes having a higher amine content.

Example 3: Yellowing Evaluation of Textiles Treated with Aminopolysiloxanes of the Method of the Present Invention Aminopolysiloxanes 1–5, VII, Controls A, B and C (dimethyl silicone oil) defined in Example 1, were applied on 100% cotton and 65/35 polyester-cotton blend from the part bath. A durable press resin (DMDHEU, which is commercially available) and curing catalyst ($MgCl_2$) were used in all treatments to simulate typical textile finishing procedure. The polymer concentration in the treating composition (containing the aminopolysiloxane, durable press resin, curing catalyst and water) was 1%. Wet pick up was adjusted to 80% for the blend and 100% for the cotton; curing conditions were 171° C. for 1.5 minutes. To evaluate yellowing properties of the finish, treated fabrics were scorched in the oven at 200° C. for 100 second and the whiteness was determined using the COLORQUEST® Colorimeter from Hunter Lab. Whiteness/reflectance data are summarized in Table 3. Panel softness results from Table 1 have been repeated for ease of comparison.

TABLE 3

| | 100% Cotton | | 65/35 Blend | |
|---|---|---|---|---|
| | Whiteness | Softness | Whiteness | Softness |
| A | 36.3 | 3.0 | 51.2 | 3.0 |
| B | 33.9 | 2.0 | 43.8 | 2.0 |
| C | 44.9 | 8.0 | 59.6 | 7.0 |
| 1 | 41.9 | 2.5 | 54.2 | 2.0 |
| 2 | 40.2 | 2.5 | 52.0 | 2.5 |
| 3 | 38.5 | 2.5 | 56.0 | 2.0 |
| 4 | 40.2 | 2.0 | 52.4 | 2.5 |
| 5 | 39.8 | 3.0 | 56.1 | 3.0 |
| I | 36.8 | 2.0 | — | — |
| II | 37.1 | 1.5 | — | — |
| III | 36.2 | 1.0 | — | — |
| IV | 40.0 | 3.5 | — | — |
| V | 41.0 | 3.5 | — | — |
| VI | 42.7 | 3.5 | — | — |
| VII | 38.2 | 2.5 | 55.2 | 2.0 |

We claim:

1. A method for treating a textile to impart amine-like softness and reduced yellowing, which method consists essentially of:

(a) treating a textile with an aminopolysiloxane composition consisting essentially of aminopolysiloxanes having an amine content as $NH_2$ ranging from about 0.15 to 0.25% by weight and having a molecular weight of at least about 30,000, which are essentially free of organotitanate, organozirconate or organogermanate, wherein the aminopolysiloxane is of the formula $PR_2SiO(R_2SiO)_a(RQSiO)_bSiR_2P$, where each R is the same or different and is a monovalent hydrocarbon selected from the group consisting of an alkyl having 1 to 10 carbon atoms, an aryl having 6 to 10 carbon atoms, and an aralkyl having from 7 to 10 carbon atoms; P is selected from the group consisting of R, Q, hydroxy and an alkoxy having 1 to 4 carbon atoms; Q is of the formula $(X)_d(X^1)_e(Y)_f—N(R^1)(R^2)$, where X is alkylene group having 1 to 8 carbon atoms, $X^1$ is selected from the group consisting of alkylene having 1 to 4 carbon atoms, a phenylene and an oxypropylene, the oxygen atom of which is bonded to the carbon atom of Y; Y is a hydroxyl-substituted acyclic or cyclic alkylene group having no more than eight carbon atoms, d, e and f are 0 or 1 provided the sum d+e is one and the sum e+f is 0 or 2, the ratio of a:b is between about 83:1 to about 330:1 and $R^1$ and $R^2$ are independently hydrogen, an alkyl group, having 1 to 8 carbon atoms or alkyleneamino having the formula: $C_gH_{2g}N(R^3)(R^4)$ wherein $R^3$ and $R^4$ are independently hydrogen, an alkyl group having 1 to 8 carbon atoms or a hydroxyalkyl group having 2 to 4 carbon atoms, and g is an integer from 2 to 8; and a and b are selected such that the amine content of the aminopolysiloxane ranges from 0.15 to 0.25 weight percent as $NH_2$ and the molecular weight ranges from 30,000 to 80,000.

2. The method of claim 1, wherein a ranges from about 400 to about 1100; b ranges from about 1.4 to 13; the ratio of a to b ranges from about 83 to 330.

3. The method of claim 2, wherein a ranges from about 470 to 800 and b ranges from about 1.75 to 9.6 and the molecular weight ranges from about 35,000 to 60,000.

4. The method of claim 1 wherein the textile is cotton or a cotton polyester blend.

5. The method of claim 1 wherein the textile is treated with the aminopolysiloxane to afford an add-on from about 0.1% to 2.0% by weight of the aminopolysiloxane based upon the weight of the textile.

6. The method of claim 1 wherein the textile is treated with an emulsion of the aminopolysiloxane.

7. A textile treated according to the method of claim 1.

* * * * *